US008992179B2

(12) United States Patent
Stein et al.

(10) Patent No.: US 8,992,179 B2
(45) Date of Patent: Mar. 31, 2015

(54) TURBINE OF A TURBOMACHINE

(75) Inventors: Alexander Stein, Simpsonville, SC (US); Bradley Taylor Boyer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 555 days.

(21) Appl. No.: 13/284,112

(22) Filed: Oct. 28, 2011

(65) Prior Publication Data

US 2013/0108424 A1 May 2, 2013

(51) Int. Cl.

| | |
|---|---|
| ***B63H 1/16*** | (2006.01) |
| ***F01D 5/30*** | (2006.01) |
| ***B64C 11/00*** | (2006.01) |
| ***F01D 5/14*** | (2006.01) |

(52) U.S. Cl.

CPC ..... *F01D 5/145* (2013.01)
USPC ..... 416/193 R; 416/193 A

(58) Field of Classification Search

CPC ..... F01D 5/141; F01D 5/143; F01D 5/146; F01D 5/145; F05D 2240/127; F05D 2240/302
USPC ..... 416/189, 191, 193 A, 228, 231, 235, 416/236 R; 415/914

See application file for complete search history.

(56) References Cited

U.S. PATENT DOCUMENTS

| | | | | |
|---|---|---|---|---|
| 891,383 | A | | 6/1908 | Steinmetz |
| 2,392,673 | A | | 1/1946 | Kraft |
| 3,635,585 | A | | 1/1972 | Metzler, Jr. |
| 3,854,842 | A | | 12/1974 | Caudill |
| 4,194,869 | A | | 3/1980 | Corcokios |
| 4,465,433 | A | * | 8/1984 | Bischoff ..... 416/223 A |
| 4,741,667 | A | | 5/1988 | Price et al. |
| 5,326,221 | A | | 7/1994 | Amyot et al. |
| 5,375,972 | A | | 12/1994 | Gray |
| 5,397,215 | A | | 3/1995 | Spear et al. |
| 5,466,123 | A | | 11/1995 | Rose |
| 5,525,038 | A | | 6/1996 | Sharma et al. |
| 5,581,996 | A | | 12/1996 | Koch et al. |

(Continued)

FOREIGN PATENT DOCUMENTS

| | | |
|---|---|---|
| EP | 2138727 A2 | 12/2009 |
| WO | 03052240 A2 | 6/2003 |

OTHER PUBLICATIONS

Extended European Search Report cited in EP Application No. 12187836.7-1610, dated Mar. 4, 2013, pp. 1-7.

(Continued)

*Primary Examiner* — Dwayne J White
*Assistant Examiner* — Brian P Wolcott
(74) *Attorney, Agent, or Firm* — Cantor Colburn LLP

(57) ABSTRACT

A turbomachine is provided and includes first and second endwalls disposed to define a pathway, each of the first and second endwalls including a surface facing the pathway and first and second blades extendible across the pathway from at least one of the first and second endwalls, each of the first and second blades having an airfoil shape and being disposed such that a pressure side of the first blade faces a suction side of the second blade. A portion of the surface of at least one of the first and second endwalls between the first and second blades has at least a first hump proximate to a leading edge and the pressure side of the first blade, and a second hump disposed at 10-60% of a chord length of the first blade and proximate to the pressure side thereof.

20 Claims, 2 Drawing Sheets

(56) References Cited

U.S. PATENT DOCUMENTS

| | | | | |
|---|---|---|---|---|
| 5,927,946 | A | 7/1999 | Lee | |
| 6,077,036 | A | 6/2000 | Heffron et al. | |
| 6,224,336 | B1 | 5/2001 | Kercher | |
| 6,283,713 | B1 | 9/2001 | Harvey et al. | |
| 6,375,420 | B1 | 4/2002 | Tanuma et al. | |
| 6,478,537 | B2 | 11/2002 | Junkin | |
| 6,561,761 | B1 | 5/2003 | Decker et al. | |
| 6,669,445 | B2 | 12/2003 | Staubach et al. | |
| 6,709,223 | B2 | 3/2004 | Walto et al. | |
| 6,779,973 | B2 | 8/2004 | Ito et al. | |
| 6,802,695 | B2 | 10/2004 | Haller | |
| 6,969,232 | B2 * | 11/2005 | Zess et al. | 415/191 |
| 7,044,710 | B2 | 5/2006 | Naik et al. | |
| 7,186,074 | B2 | 3/2007 | Blatchford et al. | |
| 7,390,171 | B2 | 6/2008 | Francini | |
| 7,520,728 | B2 | 4/2009 | Sleiman et al. | |
| 7,632,075 | B2 | 12/2009 | Liang et al. | |
| 7,740,449 | B1 | 6/2010 | Brown et al. | |
| 7,887,297 | B2 | 2/2011 | Allen-Bradley et al. | |
| 8,011,889 | B1 | 9/2011 | Liang | |
| 8,459,956 | B2 * | 6/2013 | Pandey et al. | 416/243 |
| 2002/0054817 | A1 | 5/2002 | Tanuma et al. | |
| 2002/0098082 | A1 | 7/2002 | Ito et al. | |
| 2002/0197156 | A1 | 12/2002 | Haller | |
| 2005/0019157 | A1 | 1/2005 | Tominaga et al. | |
| 2006/0120864 | A1 | 6/2006 | Lu et al. | |
| 2006/0140768 | A1 * | 6/2006 | Tam et al. | 416/193 A |
| 2006/0222490 | A1 | 10/2006 | Senoo et al. | |
| 2006/0269399 | A1 | 11/2006 | Girgis et al. | |
| 2007/0086891 | A1 | 4/2007 | Nomura et al. | |
| 2007/0224035 | A1 | 9/2007 | Nigmatulin | |
| 2007/0258810 | A1 * | 11/2007 | Aotsuka et al. | 415/206 |
| 2007/0258818 | A1 * | 11/2007 | Allen-Bradley et al. | 416/193 A |
| 2008/0050243 | A1 | 2/2008 | Liang | |
| 2008/0175714 | A1 | 7/2008 | Spangler et al. | |
| 2008/0199310 | A1 | 8/2008 | Nomura et al. | |
| 2009/0162193 | A1 | 6/2009 | Mariotti et al. | |
| 2010/0074734 | A1 | 3/2010 | Little | |
| 2010/0158696 | A1 | 6/2010 | Pandey et al. | |
| 2010/0172749 | A1 | 7/2010 | Mitsuhashi et al. | |
| 2010/0254797 | A1 | 10/2010 | Grover et al. | |
| 2010/0284818 | A1 * | 11/2010 | Sakamoto et al. | 416/241 R |
| 2010/0300101 | A1 | 12/2010 | Swintek et al. | |
| 2011/0052387 | A1 | 3/2011 | Kneeland et al. | |
| 2011/0052413 | A1 | 3/2011 | Kwon et al. | |
| 2013/0017095 | A1 | 1/2013 | Lee et al. | |

OTHER PUBLICATIONS

Office Action issued in U.S. Appl. No. 13/284,010 dated Apr. 15, 2014, pp. 1-22.

Extended European Search Report for EP Application No. 12189881.1-1610, dated May 13, 2014, pp. 1-6.

Extended European Search Report for EP Application No. 12189836.5-1607, dated Jun. 20, 2013, pp. 1-6.

* cited by examiner

TURBINE OF A TURBOMACHINE

BACKGROUND OF THE INVENTION

The subject matter disclosed herein relates to a turbomachine and, more particularly, to a turbine of a turbomachine having a multiple hump endwall.

A turbomachine, such as a gas turbine engine, may include a compressor, a combustor and a turbine. The compressor compresses inlet gas and the combustor combusts the compressed inlet gas along with fuel to produce high temperature fluids. Those high temperature fluids are directed to the turbine where the energy of the high temperature fluids is converted into mechanical energy that can be used to generate power and/or electricity. The turbine is formed to define an annular pathway through which the high temperature fluids pass.

At one or more axial stages of the turbine, rotating blades typically exhibit strong secondary flows at various turbine stages whereby the high temperature fluids flow in a direction transverse to the main flow direction through the pathway. These secondary flows can negatively impact the stage efficiency at each of those various stages.

BRIEF DESCRIPTION OF THE INVENTION

According to one aspect of the invention, a turbine of a turbomachine is provided and includes first and second endwalls disposed to define a pathway, each of the first and second endwalls including a surface facing the pathway and first and second blades extendible across the pathway from at least one of the first and second endwalls, each of the first and second blades having an airfoil shape and being disposed such that a pressure side of the first blade faces a suction side of the second blade. A portion of the surface of at least one of the first and second endwalls between the first and second blades has at least a first hump proximate to a leading edge and the pressure side of the first blade, and a second hump disposed at 10-60% of a chord length of the first blade and proximate to the pressure side thereof.

According to another aspect of the invention, a turbine of a turbomachine is provided and includes first and second annular endwalls disposed to define an annular pathway, each of the first and second endwalls including a surface facing the annular pathway and an annular array of blades extendible across the pathway from at least one of the first and second endwalls, each of the blades having an airfoil shape and being disposed such that a pressure side of one of the blades faces a suction side of an adjacent one of the blades. A portion of the surface of at least one of the first and second endwalls between the one of the blades and the adjacent one of the blades has at least a first hump proximate to a leading edge and the pressure side of the one of the blades, and a second hump disposed at 10-60% of a chord length of the one of the blades and proximate to the pressure side thereof.

According to yet another aspect of the invention, a turbomachine is provided and includes a compressor to compress inlet gas to produce compressed inlet gas, a combustor to combust the compressed inlet gas along with fuel to produce a fluid flow and a turbine fluidly coupled to the combustor. The turbine includes first and second endwalls defining an annular pathway through which the fluid flow is directable, the first endwalls being disposed within the second endwall and an axial stage of aerodynamic elements disposed to extend through the pathway between the first and second endwalls and to thereby aerodynamically interact with the fluid flow. The first endwall exhibits non-axisymetric contouring between adjacent aerodynamic elements with multiple humps proximate to a pressure side of one of the aerodynamic elements.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
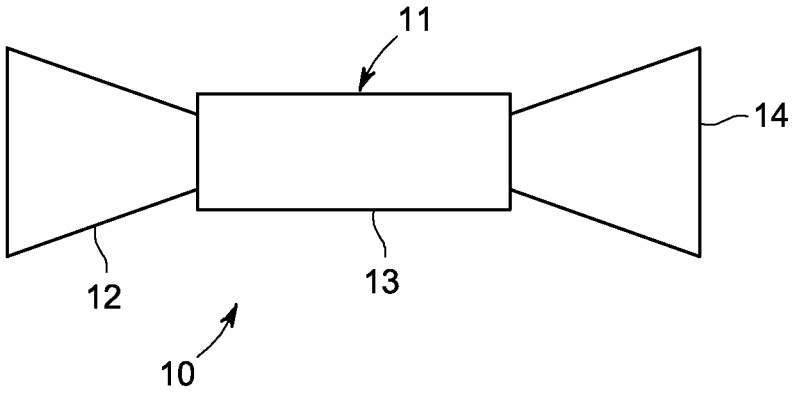
FIG. 1 is a schematic diagram of a gas turbine engine.
Figure 2:
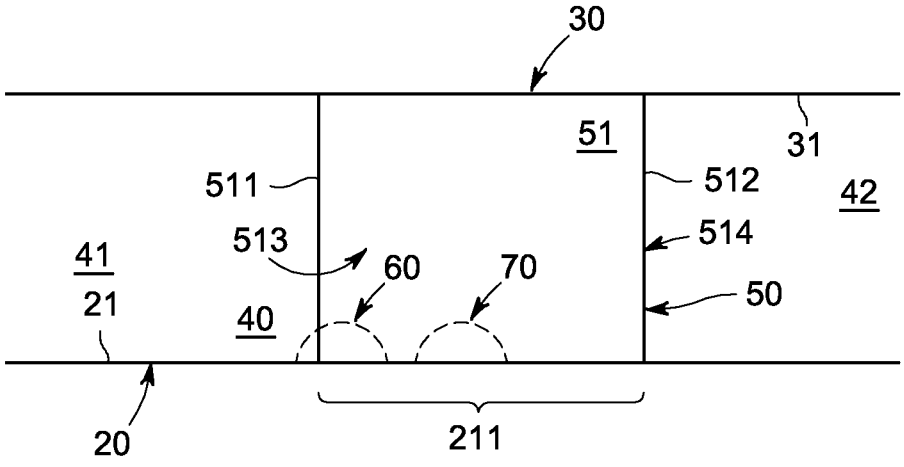
FIG. 2 is a side view of a portion of a turbine of the gas turbine engine of FIG. 1.

With reference to FIGS. 1 and 2 and, in accordance with aspects of the invention, a turbomachine 10 is provided as, for example, a gas turbine engine 11. As such, the turbomachine 10 may include a compressor 12, a combustor 13 and a turbine 14. The compressor 12 compresses inlet gas and the combustor 13 combusts the compressed inlet gas along with fuel to produce a fluid flow of, for example, high temperature fluids. Those high temperature fluids may be directed to the turbine 14 where the energy of the high temperature fluids is converted into mechanical energy that can be used to generate power and/or electricity.

The turbine 14 includes a first annular endwall 20 and a second annular endwall 30, which is disposed about the first annular endwall 20 to define an annular pathway 40. The annular pathway 40 extends from an upstream section 41, which is proximate to the combustor 13, to a downstream section 42, which is remote from the combustor 13. The high temperature fluids are output from the combustor 13 and pass through the turbine 14 along the pathway 40 from the upstream section 41 to the downstream section 42. Each of the first and second endwalls 20 and 30 includes a respective hot gas path facing surface 21 and 31 that faces inwardly toward the annular pathway 40.

At one or more axial stages of the turbine 14 an annular array of aerodynamic elements, such as axially aligned blades 50, are provided. Each blade 50 of each stage is extendible across the pathway 40 from at least one or both of the first and second endwalls 20 and 30 to aerodynamically interact with the high temperature fluids flowing through the pathway 40. Each of the blades 50 may have an airfoil shape 51 with a leading edge 511 and a trailing edge 512 that opposes the leading edge 511, a pressure side 513 extending between the leading edge 511 and the trailing edge 512 and a suction side 514 opposing the pressure side 513 and extending between the leading edge 511 and the trailing edge 512. Each of the blades 50 may be disposed at the one or more axial stages such that a pressure side 513 of any one of the blades 50 faces a suction side 514 of an adjacent one of the blades 50 and defines an associated pitch. With this configuration, as the high temperature fluids pass along the pathway 40, the high temperature fluids aerodynamically interact with the blades 50 and cause the annular array of blades 50 at each axial stage to rotate about a centerline of the turbine 14.

Normally, the configuration of the blades 50 has a tendency to generate secondary flows in directions transverse to the direction of the main flow through the pathway 40. These secondary flows may originate at or near the leading edge 511 where the incoming endwall boundary layer rolls into two vortices that propagate into the bucket passage and may cause a loss of aerodynamic efficiency. In accordance with aspects, however, the strength of these vortices can be decreased and possibly prevented by placing at least one or more of a first endwall hump near the leading edge 511.

Furthermore, a cross-passage pressure gradient formed between adjacent blades 50 may give rise to another type of secondary flow component as fluid migrates from high to low pressure regions across the passage 40. This cross-passage flow migration may also cause a loss in aerodynamic performance. In accordance with further aspects, a second endwall hump aft or downstream of the leading edge 511 and the first endwall hump may accelerate the local fluid. Such acceleration may lead to a reduction in cross-passage flow migration to thereby improve aerodynamic efficiencies.

Figure 3:
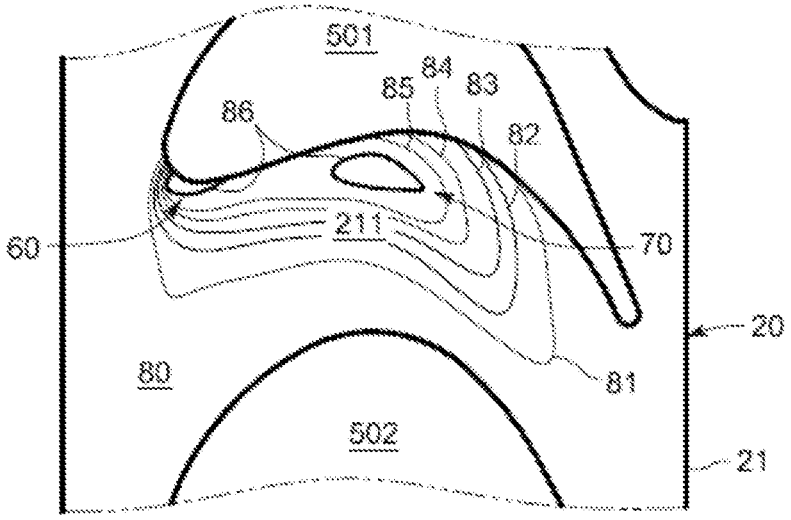
FIG. 3 is a radial view of a topographical map of the portion of the turbine of FIG. 3.

Thus, as shown in FIG. 2 and with reference to FIG. 3, a portion 211 of the surface 21 of the first endwall 20 between one of the blades 501 at a particular axial stage of the turbine 14 and an adjacent one of the blades 502 has at least a first hump 60 and a second hump 70 provided thereon. For purposes of clarity and brevity, the first hump 60 and the second hump 70 will be described below as being formed on the first endwall 20, which may be disposed radially within the second endwall 30, although it is to be understood that this embodiment is merely exemplary and that similar humps could be provided on the second endwall 30 as well.

The first hump 60 may be disposed proximate to the leading edge 511 and the pressure side 513 of one of the blades 501. The second hump 70 may be disposed at 10-60% of a chord length of one of the blades 501 and proximate to the pressure side thereof 513.

With reference to FIG. 3, a topographical map of the first hump 60 and the second hump 70 is illustrated. As shown in FIG. 3, the first hump 60 and the second hump 70 are defined at a given axial stage of a turbine 14 between the pressure side 513 of one of the blades (the "first" blade) 501 and the suction side 514 of the adjacent one of the blades (the "second" blade) 502. The first hump 60 and the second hump 70 rise radially outwardly from the portion 211 of the hot gas path facing surface 21 of the first endwall 20. The topographical map illustrates that the hot gas path facing surface 21 establishes a zeroed first radial height 80. The first hump 60 and the second hump 70 each rise radially outwardly from this first radial height 80 through at least second through seventh radial heights 81-86 such that they each protrude radially outwardly into the pathway 40.

In accordance with embodiments, the non-dimensional hump radius at the second radial height 81 is approximately 0.175 relative to the first radial height 80, the non-dimensional hump radius at the third radial height 82 is approximately 0.25 relative to the first radial height 80, the non-dimensional hump radius at the third radial height 83 is approximately 0.325 relative to the first radial height 80, the non-dimensional hump radius at the fourth radial height 84 is approximately 0.4 relative to the first radial height 80, the non-dimensional hump radius at the fifth radial height 85 is approximately 0.475 relative to the first radial height 80 and the non-dimensional hump radius at the sixth radial height 86 is approximately 0.55 relative to the first radial height 80.

In accordance with further embodiments, the first hump 60 may have a height from the hot gas path facing surface 21 of about 6.7% of a span of the first blade 501, the first hump 60 may be disposed at 0-10% of the chord length of the first blade 501 and the first hump 60 may be disposed at 0-10% of an associated pitch. The second hump 70 may have a height from the hot gas path facing surface 21 of about 5.9% of a span of the first blade 501, the second hump 70 may be disposed at about 42% of the chord length of the first blade 501 and the second hump 70 may be disposed at about 16.6% of an associated pitch.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine of a turbomachine, comprising:

first and second endwalls disposed to define a pathway, each of the first and second endwalls including a surface facing the pathway; and first and second blades extendible across the pathway from at least one of the first and second endwalls, each of the first and second blades having an airfoil shape and being disposed such that a pressure side of the first blade faces a suction side of the second blade, a portion of the surface of at least one of the first and second endwalls between the first and second blades having at least:

a first hump proximate to a leading edge and the pressure side of the first blade, and a second hump disposed at 10-60% of a chord length of the first blade and proximate to the pressure side thereof, and a lowest radial height adjacent to the suction side of the second blade.

2. The turbine according to claim 1, wherein the first and second blades are axially aligned within the pathway.

3. The turbine according to claim 1, wherein the first hump has a height from the surface of the at least one of the first and second endwalls of about 6.7% of a span of the first blade.

4. The turbine according to claim 1, wherein the first hump is disposed at 0-10% of the chord length of the first blade, the chord length being measured from the leading edge of the first blade.

5. The turbine according to claim 1, wherein the first hump is disposed at 0-10% of an associated pitch.

6. The turbine according to claim 1, wherein the second hump has a height from the surface of the at least one of the first and second endwalls of about 5.9% of a span of the first blade.

7. The turbine according to claim 1, wherein the second hump is disposed at about 42% of the chord length of the first blade.

8. The turbine according to claim 1, wherein the second hump is disposed at about 16.6% of an associated pitch between the blades.

9. A turbine of a turbomachine, comprising:

first and second annular endwalls disposed to define an annular pathway, each of the first and second endwalls including a surface facing the annular pathway; and an annular array of blades extendible across the pathway from at least one of the first and second endwalls, each of the blades having an airfoil shape and being disposed such that a pressure side of one of the blades faces a suction side of an adjacent one of the blades, a portion of the surface of at least one of the first and second endwalls between the one of the blades and the adjacent one of the blades having at least:

a first hump proximate to a leading edge and the pressure side of the one of the blades, and a second hump disposed at 10-60% of a chord length of the one of the blades, proximate to the pressure side thereof and entirely between the one of the blades and the adjacent one of the blades, wherein summits of the first and second humps rise from a common, non-zero elevational portion, the common, non-zero elevational portion comprising:

a steep portion adjacent to the leading edge;

a first ridge directed away from the leading edge; and a second ridge directed transversely with respect to the first ridge.

10. The turbine according to claim 9, wherein the blades of the annular array of the blades are axially aligned within the pathway.

11. The turbine according to claim 9, wherein the first hump has a height from the surface of the at least one of the first and second endwalls of about 6.7% of a span of the one of the blades and an entirety of an area of the portion of the surface between the first and second humps has a non-zero elevation relative to the surface.

12. The turbine according to claim 9, wherein the first hump is disposed at 0-10% of the chord length of the blades, the chord length being measured from respective leading edges of the blades.

13. The turbine according to claim 9, wherein the first hump is disposed at 0-10% of an associated pitch.

14. The turbine according to claim 9, wherein the second hump has a height from the surface of the at least one of the first and second endwalls of about 5.9% of a span of the blades.

15. The turbine according to claim 9, wherein the second hump is disposed at about 42% of the chord length of the blades.

16. The turbine according to claim 9, wherein the second hump is disposed at about 16.6% of an associated pitch between the blades.

17. A turbomachine, comprising:

a compressor to compress inlet gas to produce compressed inlet gas;

a combustor to combust the compressed inlet gas along with fuel to produce a fluid flow; and a turbine fluidly coupled to the combustor, the turbine including:

first and second endwalls defining an annular pathway through which the fluid flow is directable, the first endwall being disposed within the second endwall, an axial stage of aerodynamic elements disposed to extend through the pathway between the first and second endwalls and to thereby aerodynamically interact with the fluid flow, and the first endwall exhibiting non-axisymmetric contouring between adjacent aerodynamic elements with major portions of multiple humps entirely disposed between the adjacent aerodynamic elements and proximate to a pressure side of one of the aerodynamic elements, wherein summits of the multiple humps rise from a common, non-zero elevational portion, the common non-zero elevation portion comprising:

a steep portion adjacent to a leading edge of a proximal one of the aerodynamic elements;

a first ridge directed away from the leading edge; and a second ridge directed transversely with respect to the first ridge.

18. The turbomachine according to claim 17, wherein the multiple humps comprise a first hump proximate to a leading edge of the one of the aerodynamic elements and a second hump downstream from the first hump.

19. The turbomachine according to claim 17, wherein the multiple humps extend across a partial span of the pathway.

20. The turbomachine according to claim 17, wherein the multiple humps have different shapes.

* * * * *